US010094208B2

(12) United States Patent
Høier et al.

(10) Patent No.: US 10,094,208 B2
(45) Date of Patent: Oct. 9, 2018

(54) SOLVENT AND GAS INJECTION RECOVERY PROCESS

(75) Inventors: Lars Høier, Trondheim (NO); Jostein Alvestad, Trondheim (NO); Aurelie Lagisquet, Calgory (CA); Eimund Gilje, Oltedal (NO)

(73) Assignee: STATOIL ASA, Stavanger (NO)

( * ) Notice: Subject to any disclaimer, the term of this patent is extended or adjusted under 35 U.S.C. 154(b) by 1063 days.

(21) Appl. No.: 13/577,120

(22) PCT Filed: Feb. 3, 2011

(86) PCT No.: PCT/EP2011/051566
§ 371 (c)(1),
(2), (4) Date: Oct. 10, 2012

(87) PCT Pub. No.: WO2011/095547
PCT Pub. Date: Aug. 11, 2011

(65) Prior Publication Data

US 2013/0025858 A1 Jan. 31, 2013

(30) Foreign Application Priority Data

Feb. 4, 2010 (CA) ..... 2691889
Jun. 28, 2010 (GB) ..... 1010917.1

(51) Int. Cl.
*E21B 43/16* (2006.01)
*E21B 43/24* (2006.01)

(52) U.S. Cl.
CPC ..... *E21B 43/24* (2013.01)

(58) Field of Classification Search
CPC ..... E21B 43/168; E21B 43/24
See application file for complete search history.

(56) References Cited

U.S. PATENT DOCUMENTS 3,913,672 A * 10/1975 Allen ..... E21B 43/16 166/271
4,109,720 A * 8/1978 Allen ..... C09K 8/58 166/269

(Continued)

FOREIGN PATENT DOCUMENTS

CA 2235085 A1 10/1999
CA 2567399 A1 10/1999

(Continued)

OTHER PUBLICATIONS

CAMEO Chemicals, Pentane Data Sheet.*

(Continued)

*Primary Examiner* — William D Hutton, Jr.
*Assistant Examiner* — Avi T Skaist
(74) *Attorney, Agent, or Firm* — Birch, Stewart, Kolasch & Birch, LLP

(57) ABSTRACT

A process for the recovery of hydrocarbon such as bitumen/EHO from a hydrocarbon bearing formation in which are situated an upper injection well and a lower production well, the method comprising the steps:

preheating an area around and between the wells by circulating hot solvent through the completed interval of each of the wells until sufficient hydraulic communication between both wells is achieved;

injecting one or more hydrocarbon solvents into the upper injection well at or above critical temperature of the solvent or solvent mixture, thereby causing a mixture of hydrocarbon and solvent to flow by gravity drainage to the lower production well; and producing the hydrocarbon to the surface through the lower production well.

A non-condensable gas may be injected into the solvent chamber created by the hydrocarbon solvent.

27 Claims, 4 Drawing Sheets

(56) References Cited

U.S. PATENT DOCUMENTS

| | | | | |
|---|---|---|---|---|
| 4,127,170 | A * | 11/1978 | Redford | E21B 43/16 166/252.1 |
| 4,324,291 | A * | 4/1982 | Wong | E21B 43/24 166/252.1 |
| 4,344,485 | A | 8/1982 | Butler | |
| 4,687,058 | A * | 8/1987 | Casad | C09K 8/592 166/266 |
| 5,899,274 | A | 5/1999 | Frauenfeld et al. | |
| 6,662,872 | B2 * | 12/2003 | Gutek | E21B 43/168 166/263 |
| 6,883,607 | B2 | 4/2005 | Nenniger et al. | |
| 7,363,973 | B2 | 4/2008 | Nenniger et al. | |
| 8,434,551 | B2 * | 5/2013 | Nenniger | E21B 43/2406 166/272.1 |
| 2005/0072567 | A1 | 4/2005 | Steele et al. | |
| 2007/0181299 | A1 * | 8/2007 | Chung | E21B 43/16 166/245 |
| 2008/0017372 | A1 | 1/2008 | Gates et al. | |
| 2011/0174488 | A1 * | 7/2011 | Morris | E21B 43/16 166/305.1 |

FOREIGN PATENT DOCUMENTS

| | | | |
|---|---|---|---|
| CA | 2299790 | A1 | 8/2001 |
| CA | 2633061 | A1 | 8/2001 |
| CA | 2351148 | A1 | 12/2002 |
| CA | 2436158 | A1 | 1/2005 |
| CA | 2549614 | A1 | 12/2007 |
| CA | 2552482 | A1 | 1/2008 |
| CA | 2553297 | A1 | 1/2008 |
| CA | 2591354 | A1 | 12/2008 |
| CA | 2639851 | A1 | 3/2010 |
| CA | 2374115 | C | 5/2010 |
| WO | WO 99/67503 | A1 | 12/1999 |
| WO | WO 2008/009114 | A1 | 1/2008 |

OTHER PUBLICATIONS

CAMEO Chemicals, Butane Data Sheet.*

International Search Report issued in PCT/EP2011/051566 dated Jan. 9, 2012.

Search report issued in United Kingdom Application No. GB1010917.1 dated Jul. 14, 2010.

Albahlani et al., "A Critical Review of the Status of SAGD: Where Are We and What is Next?", Society of Petroleum Engineers, 2008, pp. 1-22.

Gupta et al., "Insights Into Some Key Issues With Solvent Aided Process", Journal of Canadian Petroleum Technology, vol. 43, No. 2, Feb. 2003, pp. 54-61.

Nenniger et al., "Dew Point vs Bubble Point: A Misunderstood Constraint on Gravity Drainage Processes", Proceedings of the Canadian International Petroleum Conference (CIPC) 2009, Paper 2009-065, Jun. 16-18, 2009, pp. 1-16.

Nenniger et al., "How Fast is Solvent Based Gravity Drainage?", Proceedings of the Canadian International Petroleum Conference/SPE Gas Technology Symposium 2008 Joint Conference (The Petroleum Society's 59th Annual Technical Meeting), Paper 2008-139, Jun. 17-19, 2008, pp. 1-14.

* cited by examiner

SOLVENT AND GAS INJECTION RECOVERY PROCESS

FIELD OF THE INVENTION

The present invention relates to a solvent and gas injection method for recovery of bitumen and extra heavy oil (EHO), and in particular relates to the recovery of solvent from the injection method.

BACKGROUND OF THE INVENTION

Recent recovery methods include steam assisted gravity drainage (SAGD) and the solvent co-injection variant thereof. Another method is the so-called N-Solv process.

SAGD (Albahlani, A. M., Babadagli, T., "A Critical review of the Status of SAGD: Where Are We and What is Next?", SPE 113283, 2008 SPE Western Regional, Bakersfield Calif.) is a method of recovering bitumen and EHO which dates back to the 1960's. A pair of wells is drilled, one above the other. The upper well is used to inject steam, optionally with a solvent. The lower well is used to collect the hot bitumen or EHO and condensed water from the steam. The injected steam forms a chamber that grows within the formation. The steam heats the oil/bitumen and reduces its viscosity so that it can flow into the lower well. Gases thus released rise in the steam chamber, filling the void space left by the oil. Oil and water flow is by a countercurrent gravity driven drainage into the lower well bore. Condensed water and the bitumen or EHO is pumped to the surface. Recovery levels can be as high as 70% to 80%. SAGD is more economic than with the older pressure-driven steam process.

The solvent co-injection variant of the SAGD process (Gupta, S., Gittins, S., Picherack, P., "Insights Into Some Key Issues With Solvent Aided Process", JCPT, February 2003, Vol 43, No 2) aims to improve the performance of SAGD by introducing hydrocarbon solvent additives to the injected steam. The operating conditions for the solvent co-injection process are similar to SAGD.

In the N-Solv process (Nenniger, J. E., Gunnewiek, L, "Dew Point vs Bubble Point: A Misunderstood Constraint on Gravity Drainage Processes", CIPC 2009, paper 065; Nenniger, J. E., Dunn, S. G. "How Fast is Solvent Based Gravity Drainage", CIPC 2008, paper 139), heated solvent vapour is injected into a gravity drainage chamber. Vapour flows from the injection well to the colder perimeter of the chamber where it condenses, delivering heat and fresh solvent directly to the bitumen extraction interface. The N-Solv extraction temperature and pressure are lower than with in situ steam SAGD. The use of solvent is also capable of extracting valuable components in bitumen while leaving high molecular weight coke forming species behind. Condensed solvent and oil then drain by gravity to the bottom of the chamber and are recovered via the production well. Some details of solvent extraction processes are described in CA 2 351 148, CA 2 299 790 and CA 2 552 482.

It is known that contaminants of the solvent injection recovery process may include non-condensable gases, such as carbon dioxide, that may act as a barrier to the process. Methods have been described to remove such gases from the solvent chamber (for example, WO2008/009114).

It is an aim of the present invention to enhance bitumen recovery from a formation and to improve recovery of the injected solvent.

DEFINITION OF THE INVENTION

To this end, the present invention provides_a process for the recovery of hydrocarbons from a hydrocarbon bearing formation in which are situated an upper injection well and a lower production well, the method comprising the steps:

circulating solvent through at least part of both of the wells until hydraulic communication between both wells is achieved;

injecting one or more hydrocarbon solvents into the upper injection well, thereby:

i) creating a solvent chamber consisting of solvent vapour and liquid, ii) mixing of the bitumen and the solvent at the boundary of the solvent chamber so formed, and iii) causing a mixture of the hydrocarbon to be extracted and solvent to drain downwards by gravity and sideways by pressure gradient towards the lower production well; and producing the mixture to the surface through the lower production well;

wherein a non-condensable gas is injected into the solvent chamber.

Furthermore, the present invention provides a process for the recovery of hydrocarbons from a hydrocarbon bearing formation in which are situated an upper injection well and a lower production well, the method comprising the steps:

circulating solvent through at least part of both of the wells until hydraulic communication between both wells is achieved;

injecting one or more hydrocarbon solvents into the upper injection well, thereby:

i) creating a solvent chamber, ii) mixing of the bitumen and the solvent at the boundary of the solvent chamber so formed, and iii) causing a mixture of the hydrocarbon and solvent to drain downwards by gravity and sideways by pressure gradient towards the lower production well; and producing the mixture to the surface through the lower production well;

wherein a non-condensable gas is injected into the solvent chamber.

By "non-condensable gas" is meant any gas or mixture of gases which have condensation (or freezing temperature if not passing through a liquid stage) temperature below 0° C. at atmospheric pressure. Typical gauges include nitrogen, lower alkanes such as methane or $CO_2$ and mixtures thereof. Methane is the preferred gas.

Although the injection of non-condensable gas is particularly preferred in the case of solvent injection recovery process using a hot solvent (i.e. using solvent at or above a critical temperature and/or at above 90° C.) in the upper injection well, it may also be used to advantage in other solvent extraction processes, such as the N-Solv process, where the solvent is injected at a lower temperature.

The injection of the non-condensable gas may occur at the end of the production period, whereby the solvent may be back produced by means of injection of non-condensable gas and pressure reduction also referred to as wind-down phase. Typically non condensable gas injection rate is less than 10% of the solvent/solvent mixture rate during the wind-down phase. A typical solvent injection mass rate per meter well ranges between 200 and 400 kg/day.

However, the injection of non-condensable gas can be employed to advantage for other purposes.

The injection of the non-condensable gas may also occur in a cyclic fashion, whereby solvent injection alternates with non-condensable gas injection starting preferably when the solvent chamber has reached the top of the reservoir, also referred to as cyclic phase.

During the cyclic phase, the non condensable gas injection rate is preferably 1 to 3% of the solvent rate in order to allow for segregation; the less dense gas (the non-condensable gas) accumulating at the top of the reservoir and creating a blanket while the solvent is pushed downwards and laterally.

A typical cycle length for the solvent injection would be 6 months and 3 months for the non condensable gas cycle. However, it is to be appreciated that the process of the invention is not restricted to these values.

The non-condensable gas or mixture should preferably be injected at a temperature from reservoir temperature up to and including the solvent injection temperature, more preferably being injected at approximately the same temperature as the solvent injection temperature.

Thus, in one preferred class of embodiments according to any aspect of the present invention, a non-condensable gas (which is less dense than the solvent/solvent mixture) may be injected in the injection well so as to displace the solvent/solvent mixture by gravity driven flooding process. In this stage of the process, the solvent/solvent mixture and the injected non-condensable gas are produced through the producer well. The non-condensable gas is separated from the solvent/solvent mixture at the surface and re-injected until sufficient recovery of the solvent/solvent mixture is achieved.

The use of a non-condensable gas may be implemented in a number of different ways. It may be injected through the same injector(s) as used for the solvent. Alternatively, the non condensable gas may be injected through one or more, preferably vertical, separate injector wells provided explicitly for that purpose. In the latter configuration, additional injection wells are drilled to inject non-condensable gases only in the upper part of the solvent chamber, thereby placing the non-condensable gas directly through separate wells. This can secure minimum mixing between the non-condensable injection gas and the hot solvents, but with the additional cost connected to drilling, completion and top-side modifications.

In a preferred embodiment of the process according to the present invention, the circulating solvent comprises one or more hydrocarbon solvents injected into the upper injection well at or above critical temperature of the solvent or solvent mixture, thereby causing a mixture of hydrocarbons and solvent to collect in the lower production well; and extracting the hydrocarbons from the lower production well.

Preferably, the hydrocarbon solvents are injected into the upper injection well so that the temperature of the solvent or solvent mixture in the upper injection well is 90° C. or more, thereby causing a mixture of hydrocarbons and solvent to collect in the lower production well.

The method may further include the step of preheating an area around and between the wells by circulating hot solvent through at least part of both of the wells until hydraulic communication between both wells is achieved, injecting one of more hydrocarbon solvents into the upper injection well at or above critical temperature of the solvent or solvent mixture, preferably 90° C. or above, thereby causing a mixture of hydrocarbons and solvent to collect in the lower production well, and extracting the hydrocarbons from the lower production well.

The injection of hot solvent above its critical temperature enhances recovery of the bitumen and EHOs from the formation. The N-Solv process of the prior art operates at low temperatures (typically up to 70° C.,) and uses propane as the preferred solvent. This can result in low drainage rates. SAGD and SAGD with solvent co-injection operate above 200° C. so the energy usage is high.

In contrast, the present invention preferably injects the hydrocarbon solvent or solvent mixture at a temperature of 90° C. to 400° C., more preferably at a temperature of 150° C. to 300° C. No steam is utilised in the process.

Typical solvents are the lower alkanes, with butane or pentane being preferred.

This embodiment of the present invention offers lower energy utilisation rates and does not require any use of water. $CO_2$ emissions are also considerably lower. The present invention also achieves faster oil drainage rates than the N-Solv process due to employing a significantly higher solvent chamber temperature than N-Solv extraction temperature.

De-asphalting of the bitumen/EHO at the boundary layer between the solvent chamber and the bitumen/EHO region can occur also in the high temperature solvent injection process of the present invention.

A single injection of non-condensable gas may be provided at or towards the end of the production period but, more preferably, periods of solvent injection and gas injection may be effected alternately. Thus, the process can be repeated in several cycles, i.e. alternating between hot solvent injection and non-condensable gas injection. This results in a gradual increase of non-condensable gases occupying larger and larger portions of the original hot solvent chamber, filling up the original hot solvent chamber from above, altering the hot solvent sweep efficiency, and vaporizing and/or displacing main parts of the hot solvents to the producer.

In general, solvent and non-condensable gas could be separated from the produced well-stream, ready to be cycled back in the reservoir or sold for other applications.

In the case of alternating cycles of gas and solvent and gas injection, the last injection period of these cycles is preferably a long injection period with non-condensable gas, to displace the remaining gas-phase of the hot solvent and vaporize out remaining intermediate components from the hot solvent and bitumen/EHO in the reservoir, produced out as gas.

The following method is particularly suited to injections in horizontal production/injection well pairs. After the last injection period, the reservoir pressure may be reduced to expand the non-condensable gas, and back-produce as much as possible of the remaining hot solvents and the non-condensable gas.

The injection of non-condensable gas can provide one or more advantages, including increased economic efficiency due to solvent recovery/recycling, improved overall extraction, less variation of EHO recovery rate over time and higher extraction rates per unit volume of solvent. Late-life cyclic injection of hot solvents and high temperature non-condensable gases establish a blanket in the upper parts of the hot solvent chamber. This enhances bitumen and EHO production and enables recovery of the injected hot solvents through displacement and/or vaporization effects.

DETAILED DESCRIPTION OF THE INVENTION

In essence, the present invention is a gravity-based thermal recovery process of bitumen and extra heavy oil with assisted recovery of the solvent that is used for the thermal recovery process.

The following are features of a non-limiting preferred class of embodiments of this recovery process entails use of a pair of substantially parallel horizontal wells, located above each other, at a vertical distance of typically from 2 to 20 meters, say 5 meters, placed at the bottom of the reservoir. In this configuration, parallel wells may be understood to include equidistant wells, horizontal wells and highly deviated wells.

The area around and between the wells is heated by circulating hot solvent through the completed interval of each of the wells until sufficient hydraulic communication between the wells is achieved.

After the pre-heating period is finished the upper well is converted to an injector and the bottom well to a producer.

A hydrocarbon solvent (or mixture of hydrocarbon solvents) of technical grade is injected in the upper well at or above critical temperature.

A mixture of bitumen/EHO and solvent is produced through the bottom well.

The solvent is separated from the produced well stream and recycled.

Without being bound by any particular theory, it is believed that the mechanisms which underlie the basic process are as follows:

Establishment and expansion of a solvent chamber,

Condensation of the solvent occurs far from the interface with the solvent chamber and the cold bitumen, The bitumen/EHO is heated by conduction to the solvent temperature in the vicinity of the solvent interface (typically a few meters), Solubilisation of solvent into oil by mechanical/convective mixing and thereby bitumen/extra heavy oil viscosity reduction, De-asphalting of the bitumen/EHO (upgrading and viscosity reduction of the bitumen/EHO), Gravity drainage of bitumen/EHO.

Typical solvents usable in any process of the present invention are hydrocarbons, e.g. lower alkanes, such as propane, butane or pentane, but not limited to these, and mixtures thereof. Butane or pentane is the solvent of choice, with pentane being preferred. The critical temperature of a solvent or solvent mixture is readily obtainable from standard texts. However, typical operating well temperature ranges for the process of the present invention, are, particularly for the solvents listed, in the range of 90-400° C., more preferably 150° C. to 300° C. The solvent injection rate is adjusted to the reservoir (chamber) properties.

A single injection of a non-condensable gas is introduced at or towards the end of the production process or alternatively, alternating periods of solvent injection and gas injection may be effected in a cyclic fashion. A gradual placement (injection) of the non-condensable gas through such a solution will have similar effects on altering the solvent sweep efficiency, and vaporizing and/or displacing main parts of the hot solvents to the producer. At the end of the solvent injection time, the injection of non-condensable gases may be continued for a while in order to displace and produce the rest of the oil. Finally, the reservoir pressure is reduced to expand the non-condensable gas, and back-produce as much as possible of the remaining hot solvents and the non-condensable gas.

The gas (e.g. methane and/or nitrogen), is introduced at a high temperature preferably at approximately same temperature as the hot solvent) is injected in the horizontal injector-well. Due to the density difference between the non-condensable gas and hot solvents, the high-temperature non-condensable gas will displace hot solvents, migrate upwards and establish a "blanket" in the upper parts of the hot solvent chamber. This establishment will partly reduce temperature loss upwards due to an insulation effect, but also alter the further hot solvent chamber development, which will be lower and wider in its development compared to not applying non-condensable gas injection.

The alteration of the hot solvent chamber will expose new areas of bitumen for the hot solvent (typically bitumen "wedges" between producer/injectors pairs), and potentially increase the bitumen recovery though improved sweep efficiency of the hot solvents. In addition, portions of the hot solvents will be recovered, either through displacement to the producers by the non-condensable gas, and/or as vaporized hot solvent components produced in the high-temperature non-condensable gas.

However, instead of a just a single injection of non-condensable gas at or towards the end of the production period, alternating periods of solvent and gas injection may be provided once the solvent has reached the top of the reservoir. This establishes a gradually growing blanket from the upper parts of the chamber that, over time, fills the entire hot solvent chamber. Consequently, this cyclic process alters the hot solvent chamber development (making the chamber lower and wider) and enhances bitumen recovery (eg from wedges) and also recovers main parts of the injected hot solvents through displacement and/or vaporization effects thereby providing a process with enhanced recovery of bitumen and efficient back production of the injected hot solvent.

As mentioned above, the technique of injecting a non-condensable gas may be used equally in other solvent recovery processes, e.g. the N-Solv process, and therefore, any reference herein to that technique wherein the solvent is at an elevated temperature such as i.e. at or above the critical temperature of the solvent and/or at above 90° C., and the non-condensable gas is injected at a temperature ranging from reservoir temperature up to and including the solvent critical temperature, should be interpreted as equally, a reference to and disclosure of the same technique wherein the solvent and/or non-condensable gas is at a lower temperature.

DESCRIPTION OF PREFERRED EMBODIMENTS

Figure 1B:
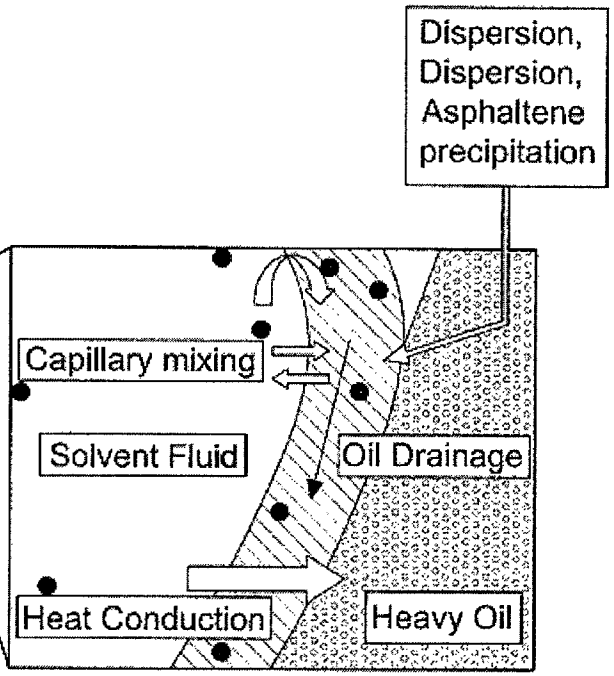
FIG. 1B shows an expanded detail of the solvent chamber—bitumen/EHO transition region.
Figure 1A:
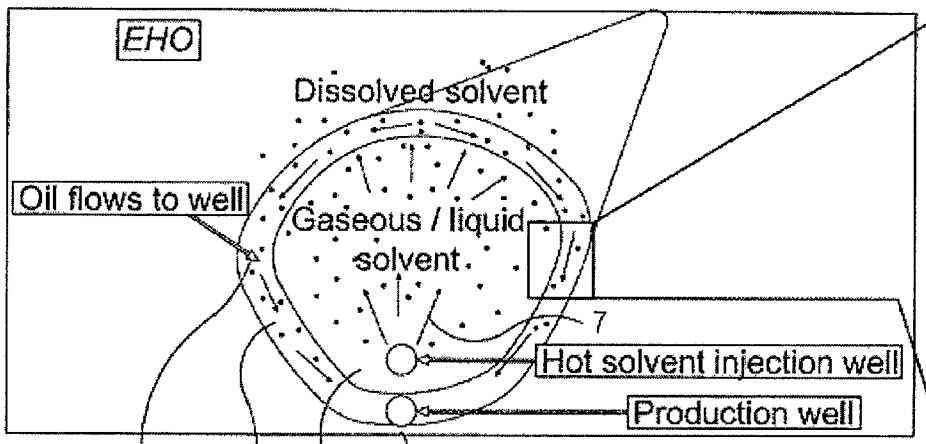
FIG. 1A shows a vertical cross section perpendicular to the horizontal well pair used in a recovery process according to the present invention, viewed along the wells.

FIG. 1A shows a vertical section perpendicular to the horizontal well pair used in a recovery process according to the present invention. The outer boundary of the solvent chamber is denoted by reference numeral 3. Situated below the upper well 1 is a production well 5. Hot solvent in vapour form is injected into the upper injection well 1 as denoted by arrows 7.

During the start-up period and prior to well conversion, the volume/region between the injection well 1 and the producing well 5, is pre-heated by circulation of hot solvent until sufficient hydraulic communication is established between the upper and lower wells. Bitumen/EHO flows (9) into the well.

Injection of hydrocarbon solvents as mentioned above causes a mixture of bitumen/EHO and solvent to:

drain downwards by gravity and sideways by pressure gradient to the lower well and be produced to the surface through the lower well by conventional well lifting means including down-hole pumps.

At the surface, the solvent can be recovered for recycling.

FIG. 1B shows an expanded detail of the solvent chamber—bitumen/EHO transition region. Solubilisation of solvent into the bitumen/EHO occurs by diffusive and convective mixing in the solvent chamber—bitumen/EHO transition region. The bitumen/EHO is de-asphalted in the presence of higher solvent concentration. As a result of both phenomena stated above, a lower viscosity mixture of bitumen/EHO and solvent flows by gravity drainage to the producing well 5.

Figure 2A:
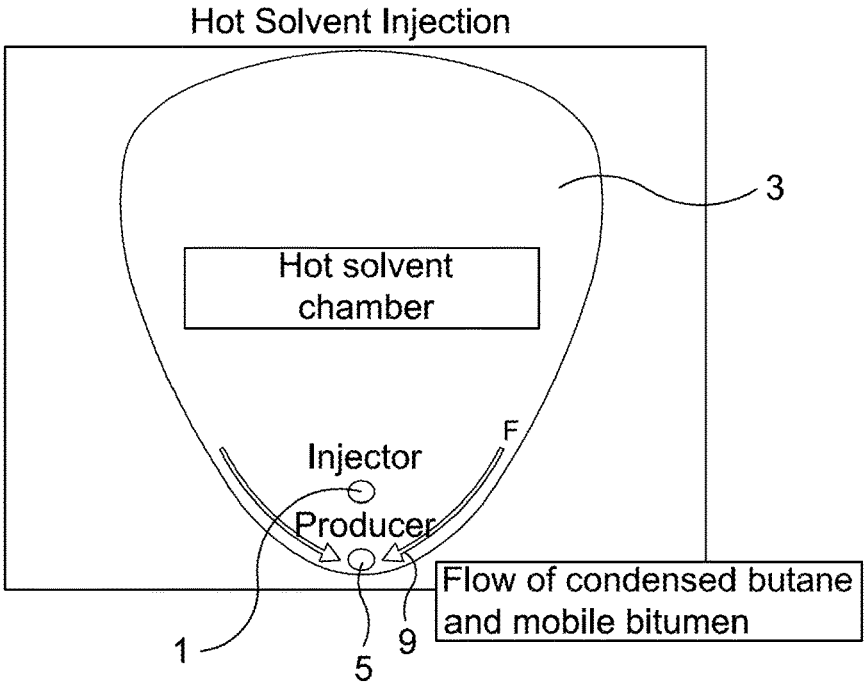
FIG. 2A shows a vertical cross-section corresponding to that shown in FIG. 1A, before injection of non-condensable gas.
Figure 2B:
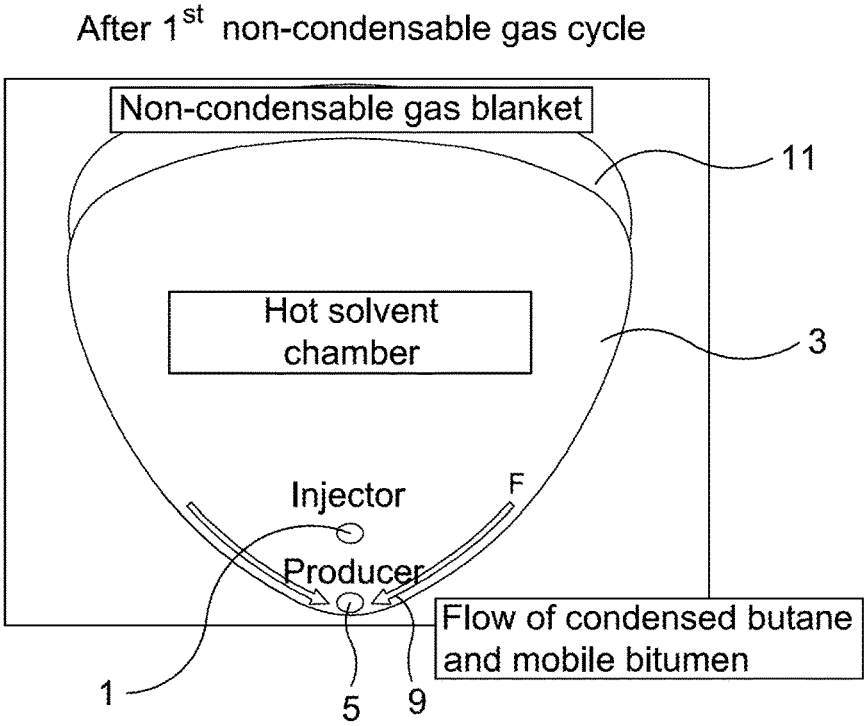
FIG. 2B shows the cross-section of FIG. 2A after a single injection of non-condensable gas.
Figure 2C:
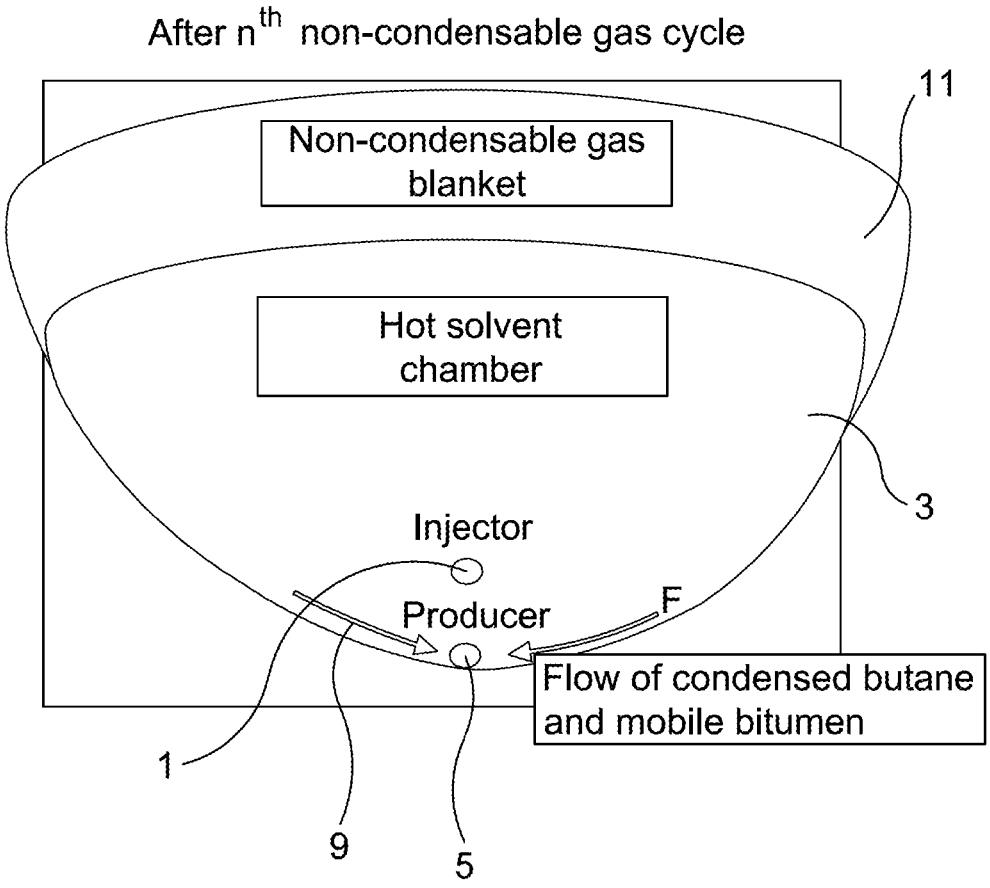
FIG. 2C shows the cross-section of FIG. 2B after 'n' cycles of non-condensable gas.

FIGS. 2A through 2C show how a non-condensable gas may be used for solvent recovery and/optimised EHO/bitumen recovery by the provision of alternating cycles of solvent and gas injection.

FIG. 2A shows the solvent chamber as used in the process described above with reference to FIGS. 1A and 1B. The reference numerals refer to the same integers as in the earlier drawings. The solvent is introduced at a temperature of approx. 250° C. and at an injection mass rate per meter well of about 300 kg/day.

FIG. 2B shows the situation after a single injection of non-condensable gas in the form of methane and/or nitrogen. In this case, the gas is injected into the well used for introduction of solvent, after solvent injection has been stopped. The gas is also introduced at a temperature of around 250° C. and at a gas injection rate of approx. 2% of the solvent injection rate in order to allow for segregation. It can be seen that a gas blanket 11 forms at the top of the solvent chamber 3. This exposes new bitumen wedges for subsequent recovery.

FIG. 2C shows the situation after subsequent further cycles of solvent injection and gas injection. The gas blanket 11 increases in volume. Recovery is further enhanced. Eventually, sufficient gas may be injected to displace most of the solvent for recovery, thus improving the overall efficiency of the process. A typical cycle length for the solvent injection is approx. 6 months, followed by a 3-month period of gas injection.

Figure 3:
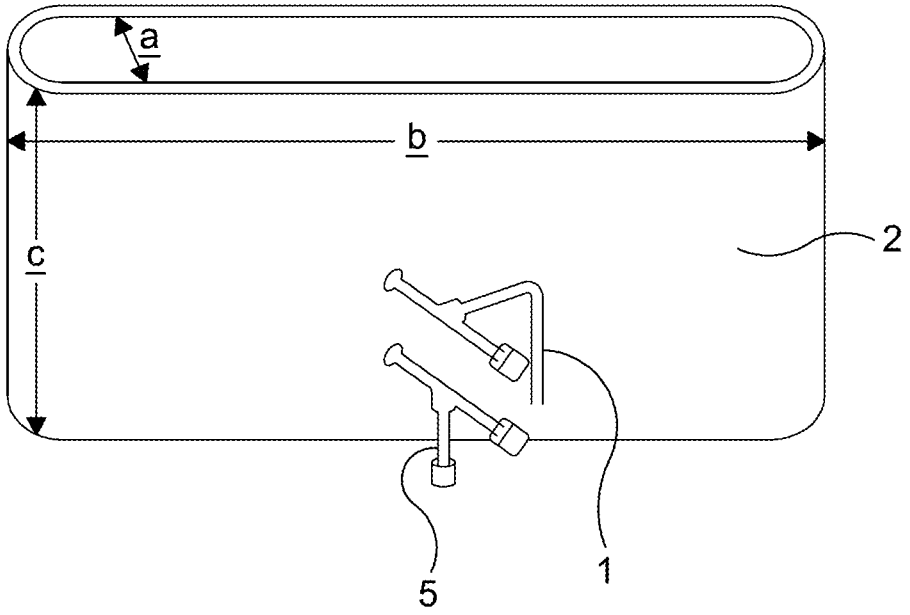
FIG. 3 is a schematic diagram of a physical model used to verify the recovery process according to one embodiment of the present invention.

FIG. 3 is a sketch of a physical model used to verify the superheated solvent recovery process according to an embodiment of the present invention. A cannister 2 having the dimensions 10 cm (a) ×80 cm (b) ×24 cm (c) represents a small scale (1:100) model of a 2-dimensional symmetry element of a reservoir perpendicular to a pair of injection and production wells 1, 5. The cannister was packed with sand and saturated with water and bitumen. The process was then carried out with butane being injected into the cannister at a injection temperature from 150° C. to 300° C. with high grade bitumen being recovered via the production well.

The results from the experiments carried out demonstrate the suitability of the process for the recovery of bitumen and extra heavy oil. The process is capable of achieving high ultimate oil (bitumen) recoveries (approx. 80%) and the produced bitumen generally has an API 2-4 units higher than the original bitumen due to asphaltene precipitation in the model. The physical experiments have been simulated with numerical reservoir simulators and reproduced with reasonable accuracy. The up-scaled simulation results indicate that a production plant of 40,000 bbl/day would have a potential of an economy (NPV) that is better than SAGD and would use approx. 50-67% of the energy used in SAGD.

In the light of the described embodiments, modifications to these embodiments, as well as other embodiments, all within the spirit and scope of the present invention, for example as defined by the appended claims, will now become apparent to persons skilled in the art.

What is claimed is:

1. A process for the recovery of hydrocarbons from a hydrocarbon bearing formation in which are situated an upper injection well and a lower production well, the method comprising the steps:

circulating solvent through at least part of both of the wells until hydraulic communication between both wells is achieved;

injecting one or more hydrocarbon solvents into the upper injection well, thereby:

(i) creating a solvent chamber consisting of solvent vapour and liquid, (ii) mixing of the formation hydrocarbons and the solvent at the boundary of the solvent chamber so formed, and (iii) causing a mixture of the hydrocarbon and solvent to drain downwards by gravity and sideways by pressure gradient towards the lower production well; and producing the mixture to the surface through the lower production well;

wherein the injection step further comprises:

injecting a non-condensable gas and the solvent into the solvent chamber during respective alternating periods in a cyclic phase, and establishing a growing blanket of non-condensable gas from the upper parts of the solvent chamber that over time fills the entire solvent chamber, wherein the last injection period is with non-condensable gas which displaces the remaining solvent vapour to the lower production well.

2. A process according to claim 1, wherein the non-condensable gas is injected via one or more injectors used for injection of the solvent or solvent mixture.

3. A process according to claim 1, wherein the non-condensable gas is injected via one or more injector wells communicating directly with the solvent chamber.

4. A process according to claim 1 wherein the injection rate of the non-condensable gas is from 1 to 3% of the solvent injection rate during an alternating cyclic phase.

5. A process according to claim 1, wherein the one or more hydrocarbon solvents are injected to the upper injection well at or above the critical temperature of the solvent.

6. A process according to claim 1, wherein the one or more hydrocarbon solvents are injected into the upper injection well at or above a temperature of 90° C.

7. A process according to claim 6, wherein the one or more hydrocarbon solvents are injected into the upper injection well within the temperature range from 150° C. to 300° C.

8. A process according to claim 1 wherein the solvent is selected from butane and pentane.

9. A process according to claim 1 wherein the non-condensable gas is injected at approximately the same temperature as the injected solvent.

10. A process according to claim 1, further comprising preheating the region between the wells by circulating hot solvent through at least part of both of the wells until hydraulic communication between both wells is achieved, wherein hot solvent is a solvent at or above a critical temperature and/or at or above 90° C.

11. A process according to claim 1, wherein solvent is separated from the produced mixture for recycling.

12. A process according to claim 1, wherein the process does not include the use of steam.

13. A process according to claim 1, wherein the process does not include the use of water.

14. A process for the recovery of hydrocarbons from a hydrocarbon bearing formation in which are situated an upper injection well and a lower production well, the method comprising the steps:

circulating solvent through at least part of both of the wells until hydraulic communication between both wells is achieved;

injecting one or more hydrocarbon solvents into the upper injection well, thereby:

(i) creating a solvent chamber, (ii) mixing of the formation hydrocarbons and the solvent at the boundary of the solvent chamber so formed, and (iii) causing a mixture of the hydrocarbon and solvent to drain downwards by gravity and sideways by pressure gradient towards the lower production well; and producing the mixture to the surface through the lower production well;

wherein the injecting step further comprises:

injecting a non-condensable gas and the solvent into the solvent chamber during respective alternating periods in a cyclic phase, and establishing a growing blanket of non-condensable gas from the upper parts of the solvent chamber that over time fills the entire solvent chamber, wherein the last injection period is with non-condensable gas which displaces the remaining solvent vapour to the lower production well.

15. A process according to claim 14, wherein the non-condensable gas is injected via one or more injectors used for injection of the solvent or solvent mixture.

16. A process according to claim 14, wherein the non-condensable gas is injected via one or more injector wells communicating directly with the solvent chamber.

17. A process according to claim 14 wherein the injection rate of the non-condensable gas is from 1 to 3% of the solvent injection rate during an alternating cyclic phase.

18. A process according to claim 14, wherein the one or more hydrocarbon solvents are injected to the upper injection well at or above the critical temperature of the solvent.

19. A process according to claim 14, wherein the one or more hydrocarbon solvents are injected into the upper injection well at or above a temperature of 90° C.

20. A process according to claim 14 wherein the solvent is selected from butane and pentane.

21. A process according to claim 14 wherein the non-condensable gas is injected at approximately the same temperature as the injected solvent.

22. A process according to claim 14, further comprising preheating the region between the wells by circulating hot solvent through at least part of both of the wells until hydraulic communication between both wells is achieved, wherein the hot solvent is a solvent at or above a critical temperature and/or at or above 90° C.

23. A process according to claim 14, wherein solvent is separated from the produced mixture for recycling.

24. A process according to claim 14, wherein the process does not include the use of steam.

25. A process according to claim 14, wherein the process does not include the use of water.

26. A process for the recovery of hydrocarbons from a hydrocarbon bearing formation in which are situated an upper injection well and a lower production well, the method comprising the steps:

circulating solvent through at least part of both of the wells until hydraulic communication between both wells is achieved;

injecting one or more hydrocarbon solvents into the upper injection well, thereby:

(i)creating a solvent chamber consisting of solvent vapour and liquid, (ii) mixing of the formation hydrocarbons and the solvent at the boundary of the solvent chamber so formed, and (iii) causing a mixture of the hydrocarbon and solvent to drain downwards by gravity and sideways by pressure gradient towards the lower production well; and producing the mixture to the surface through the lower production well;

wherein the injecting step further comprises:

injecting a non-condensable gas and the solvent into the solvent chamber during respective alternating periods in a cyclic phase to make the solvent chamber lower and wider, and establishing a growing blanket of non-condensable gas from the upper parts of the solvent chamber that over time fills the entire solvent chamber and enhance hydrocarbon recovery, wherein the last injection period is with non-condensable gas which displaces the remaining solvent vapour to the lower production well.

27. A process for the recovery of hydrocarbons from a hydrocarbon bearing formation in which are situated an upper injection well and a lower production well, the method comprising the steps:

circulating solvent through at least part of both of the wells until hydraulic communication between both wells is achieved;

injecting one or more hydrocarbon solvents into the upper injection well, thereby:

(i)creating a solvent chamber, (ii) mixing of the formation hydrocarbons and the solvent at the boundary of the solvent chamber so formed, and (iii) causing a mixture of the hydrocarbon and solvent to drain downwards by gravity and sideways by pressure gradient towards the lower production well; and producing the mixture to the surface through the lower production well;

wherein the injecting step further comprises:

injecting a non-condensable gas and the solvent into the solvent chamber during respective alternating periods in a cyclic phase to make the solvent chamber lower and wider, and establishing a growing blanket of non-condensable gas from the upper parts of the solvent chamber that over time fills the entire solvent chamber and enhance hydrocarbon recovery, wherein the last injection period is with non-condensable gas which displaces the remaining solvent vapour to the lower production well.

* * * * *